US011457518B2

(12) United States Patent
Daroussin et al.

(10) Patent No.: US 11,457,518 B2
(45) Date of Patent: Sep. 27, 2022

(54) VOLTAGE-CONTROLLED MATRIX LIGHT SOURCE WITH DIAGNOSTIC CIRCUIT FOR A MOTOR VEHICLE

(71) Applicant: VALEO VISION, Bobigny (FR)

(72) Inventors: Samuel Daroussin, Bobigny (FR); Olivier Valorge, Bobigny (FR); Marjaneh Kazemi, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 17/280,476

(22) PCT Filed: Sep. 25, 2019

(86) PCT No.: PCT/EP2019/075839
§ 371 (c)(1),
(2) Date: Mar. 26, 2021

(87) PCT Pub. No.: WO2020/064824
PCT Pub. Date: Apr. 2, 2020

(65) Prior Publication Data

US 2021/0315081 A1 Oct. 7, 2021

(30) Foreign Application Priority Data

Sep. 28, 2018 (FR) ..... 1859023

(51) Int. Cl.
*H05B 45/50* (2022.01)
*H05B 45/44* (2020.01)

(52) U.S. Cl.
CPC ..... *H05B 45/50* (2020.01); *H05B 45/44* (2020.01)

(58) Field of Classification Search
None
See application file for complete search history.

(56) References Cited

U.S. PATENT DOCUMENTS

2007/0159750 A1 7/2007 Peker et al.
2011/0134239 A1* 6/2011 Vadai ..... F21V 23/009 313/46
2013/0049599 A1* 2/2013 Logiudice ..... H05B 47/24 315/122
2014/0368798 A1* 12/2014 Gyoten ..... H05B 45/58 315/192
2017/0325300 A1* 11/2017 Drake ..... H05B 45/58
2019/0306938 A1 10/2019 Drake et al.

OTHER PUBLICATIONS

International Search Report dated Oct. 25, 2019 in PCT/EP2019/075839 filed on Sep. 25, 2019, citing documents AA-AC therein, 2 pages.

* cited by examiner

*Primary Examiner* — Anh Q Tran
(74) *Attorney, Agent, or Firm* — Oblon, McClelland, Maier & Neustadt, L.L.P.

(57) ABSTRACT

A matrix light source intended to be supplied with a voltage and having a plurality of electroluminescent semiconductor element-based elementary light sources and a common substrate in contact with an integrated circuit. The integrated circuit includes, for each elementary light source, a switching device for selectively connecting it to a voltage source on the basis of a first control signal. The substrate includes, for at least one of the elementary light sources, an open-circuit fault detection circuit for detecting an open-circuit fault with the elementary light source.

18 Claims, 2 Drawing Sheets

Figure 1:
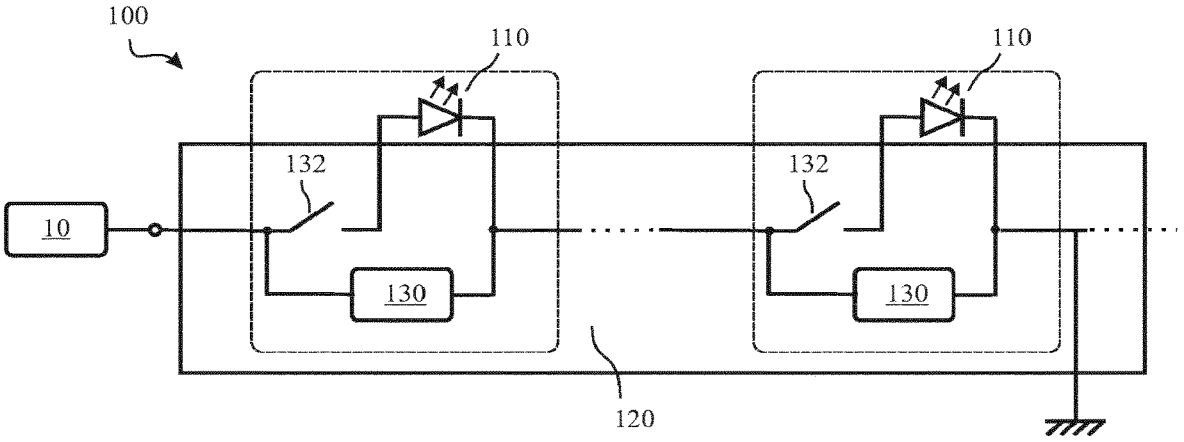

VOLTAGE-CONTROLLED MATRIX LIGHT SOURCE WITH DIAGNOSTIC CIRCUIT FOR A MOTOR VEHICLE

The invention relates to electroluminescent semiconductor element-based matrix light sources, in particular for motor vehicles. The invention relates in particular to a voltage-driven matrix light source with a diagnostic circuit.

A light-emitting diode (LED) is a semiconductor electronic component capable of emitting light when an electric current flows therethrough. In the automotive field, LED technology is increasingly being used for numerous light signaling solutions. LEDs are used to provide lighting functions such as daytime running lights, signaling lights, etc. The brightness emitted by an LED is generally dependent on the intensity of the electric current flowing therethrough. Inter alia, an LED is characterized by an electric current intensity threshold value. This maximum forward current generally decreases with increasing temperature. Likewise, when an LED emits light, a voltage drop equal to its forward voltage or nominal voltage is observed across its terminals.

The use of matrix arrays of LEDs comprising a high number of elementary electroluminescent light sources is beneficial in numerous fields of application, and in particular also in the field of lighting and signaling for motor vehicles. A matrix array of LEDs may be used for example to create light beam forms that are beneficial for lighting functions, such as headlights or daytime running lights. In addition, a plurality of different lighting functions may be produced using a single matrix, thus reducing the physical bulk in the restricted space of a motor vehicle headlight.

As is known, matrix light sources or, equivalently, pixelated light sources are controlled by a control unit that is physically remote from and electrically connected to the light source. This unit may also perform diagnostic functions with regard to the operation of the matrix source and/or the elementary light sources that form it. In the case of voltage-driven matrix light sources, it is difficult to diagnose an open-circuit fault with an elementary light source. Specifically, such a source involves a MOSFET transistor with a low voltage drop between its drain and source terminals, for selectively connecting/disconnecting an elementary light source to/from the voltage source. It therefore becomes difficult to distinguish between a non-defective source and a source with an open-circuit fault that has for example a defective anode and/or cathode terminal. In order to ensure the correct operation of a matrix light source, it is nevertheless important to be able to diagnose an open-circuit fault with its elementary light sources. This is all the more important in the field of signaling for motor vehicles. The brightnesses produced by various lighting functions of a motor vehicle are subject to regulations that a matrix light source having open-circuited light sources is liable to no longer be able to comply with.

The aim of the invention is to overcome at least one of the problems posed by the prior art. More precisely, the aim of the invention is to propose a voltage-driven matrix light source or pixelated light source capable of diagnosing an open-circuit fault with one of its constituent electroluminescent light sources.

According to a first aspect of the invention, what is proposed is a matrix light source intended to be supplied with a voltage and comprising an integrated circuit and a matrix array of electroluminescent semiconductor element-based elementary light sources. The matrix source is noteworthy in that the integrated circuit is in contact with the matrix array and comprises, for each elementary light source, a switching device for selectively connecting it to a voltage source on the basis of a first control signal. The integrated circuit furthermore comprises, for at least one of the elementary light sources, an open-circuit fault detection circuit for detecting an open-circuit fault with the elementary light source.

According to another aspect of the invention, what is proposed is an integrated circuit for a matrix light source. The integrated circuit is intended to be in mechanical and electrical contact with a matrix array of elementary light sources of the matrix light source. The integrated circuit is noteworthy in that it comprises, for each elementary light source, a switching device for selectively connecting it to a voltage source on the basis of a first control signal. The integrated circuit furthermore comprises, for at least one of the elementary light sources, an open-circuit fault detection circuit for detecting an open-circuit fault with the elementary light source.

The matrix array of elementary light sources may preferably comprise a common substrate supporting the elementary light sources. The common substrate of the matrix may preferably comprise SiC.

The integrated circuit may preferably comprise an Si substrate. The integrated circuit is preferably soldered or adhesively bonded to the matrix array of elementary light sources, for example to a common substrate supporting the elementary light sources. The integrated circuit is preferably soldered or adhesively bonded to the lower face of the common substrate, opposite the face that comprises the elementary light sources. The integrated circuit is preferably in mechanical contact, for example via fastening means, and in electrical contact with the common substrate, which has electrical connection areas on its lower face.

The detection circuit may preferably be configured so as to generate binary information on the detection of an open-circuit fault with said elementary light source.

The detection circuit may preferably comprise a memory element, the detection circuit being configured so as to store the detection information in said memory element.

The detection circuit may preferably comprise a load connected in parallel with the switching device, such that an electric current of non-negligible intensity flows through the load if the matrix source is supplied with electricity, unless the elementary light source has an open-circuit fault.

The detection circuit may preferably comprise a comparison unit, configured so as to compare the voltage drop across the terminals of said load to a predetermined threshold value.

Said load may preferably comprise a resistor connected in parallel with the switching device.

The load may preferably comprise a transistor controlled by a second control signal, the transistor representing a non-negligible resistance when it is in the closed state, and characterized in that the detection circuit comprises a control unit for generating said second control signal.

The second control signal may preferably depend on the first control signal.

The integrated circuit may preferably comprise a dedicated open-circuit fault detection circuit for each of the elementary light sources.

The elementary light sources may preferably be arranged in at least two branches of parallel sources.

According to another aspect of the invention, what is proposed is a lighting module for a motor vehicle comprising a matrix light source and a circuit for driving the supply of electric power to said source. The lighting module is noteworthy in that the matrix light source is in accordance with one aspect of the invention.

According to yet another aspect of the invention, what is proposed is a method for detecting an open-circuit fault with an electroluminescent semiconductor element-based elementary light source of a matrix light source supplied with a voltage and having a plurality of such elementary light sources as well as a common substrate. The substrate is in contact with an integrated circuit that comprises, for each elementary light source, a switching device for selectively connecting it to the voltage source on the basis of a first control signal. The method is noteworthy in that it comprises the following steps:

supplying a voltage to the matrix light source by way of a control device for the matrix light source, generating at least a first signal for controlling the state of the switching device so as to selectively connect at least one elementary light source of the matrix light source to the voltage source;

when said elementary light source is not connected to the voltage source by way of its switching device, comparing the voltage drop across the terminals of a load connected in parallel with the switching device to a predetermined threshold voltage;

detecting the presence of an open-circuit fault with said elementary light source on the basis of the result of this comparison.

The pixelated light source, or equivalently, the matrix light source, may preferably comprise at least one matrix array of electroluminescent elements—the elementary light sources, also called monolithic array, being arranged in at least two columns by at least two rows. The electroluminescent source preferably comprises at least one monolithic matrix array of electroluminescent elements, also called a monolithic matrix array.

In a monolithic matrix array, the electroluminescent elements are grown from a common substrate and are electrically connected so as to be able to be activated selectively, individually or by subset of electroluminescent elements. Each electroluminescent element or group of electroluminescent elements may thus form one of the elementary emitters of said pixelated light source that is able to emit light when its or their material is supplied with electricity.

Various arrangements of electroluminescent elements may meet this definition of a monolithic matrix array, provided that the electroluminescent elements have one of their main dimensions of elongation substantially perpendicular to a common substrate and that the spacing between the elementary emitters, formed by one or more electroluminescent elements grouped together electrically, is small in comparison with the spacings that are imposed in known arrangements of flat square chips soldered to a printed circuit board.

The substrate may be made predominantly of semiconductor material. The substrate may comprise one or more further materials, for example non-semiconductor materials. These electroluminescent elements, of submillimeter dimensions, are for example arranged so as to project from the substrate so as to form rods of hexagonal cross section. The electroluminescent rods originate on a first face of a substrate. Each electroluminescent rod, formed in this case using gallium nitride (GaN), extends perpendicularly, or substantially perpendicularly, projecting from the substrate, in this case produced from silicon, with other materials, such as silicon carbide, being able to be used without departing from the context of the invention. By way of example, the electroluminescent rods could be produced from an alloy of aluminum nitride and of gallium nitride (AlGaN), or from an alloy of aluminum, indium and gallium phosphides (AlInGaP). Each electroluminescent rod extends along a longitudinal axis defining its height, the base of each rod being arranged in a plane of the upper face of the substrate.

The electroluminescent rods of one and the same monolithic matrix array advantageously have the same shape and the same dimensions. They are each delimited by an end face and by a circumferential wall that extends along the axis of elongation of the rod. When the electroluminescent rods are doped and subjected to polarization, the resulting light at the output of the semiconductor source is emitted mainly from the circumferential wall, it being understood that light rays may also exit from the end face. The result of this is that each electroluminescent rod acts as a single light-emitting diode and that the light output of this source is improved firstly by the density of the electroluminescent rods that are present and secondly by the size of the lighting surface defined by the circumferential wall and that therefore extends over the entire perimeter and the entire height of the rod. The height of a rod may be between 2 and 10 μm, preferably 8 μm; the largest dimension of the end face of a rod is less than 2 μm, preferably less than or equal to 1 μm.

It is understood that, when forming the electroluminescent rods, the height may be modified from one area of the pixelated light source to another in such a way as to boost the luminance of the corresponding area when the average height of the rods forming it is increased. Thus, a group of electroluminescent rods may have a height, or heights, that are different from another group of electroluminescent rods, these two groups forming the same semiconductor light source comprising electroluminescent rods of submillimeter dimensions. The shape of the electroluminescent rods may also vary from one monolithic matrix array to another, in particular over the cross section of the rods and over the shape of the end face. The rods have a generally cylindrical shape, and they may in particular have a polygonal and more particularly hexagonal cross section. It is understood that it is important, for light to be able to be emitted through the circumferential wall, that the latter has a polygonal or circular shape.

Moreover, the end face may have a shape that is substantially planar and perpendicular to the circumferential wall, such that it extends substantially parallel to the upper face of the substrate, or else it may have a shape that is curved or pointed at its center, so as to increase the directions in which the light exiting from this end face is emitted.

The electroluminescent rods may preferably be arranged in a two-dimensional matrix array. This arrangement could be such that the rods are arranged in a quincunx. Generally speaking, the rods are arranged at regular intervals on the substrate and the distance separating two immediately adjacent electroluminescent rods, in each of the dimensions of the matrix array, should be at least equal to 2 μm, preferably between 3 μm and 10 μm, such that the light emitted through the circumferential wall of each rod is able to exit from the matrix array of electroluminescent rods. Provision is furthermore made for these separating distances, measured between two axes of elongation of adjacent rods, not to be greater than 100 μm.

As an alternative, the monolithic matrix array may comprise electroluminescent elements formed by layers of epitaxial electroluminescent elements, in particular a first layer of n-doped GaN and a second layer of p-doped GaN, on a single substrate, for example made of silicon carbide, and which is sliced (by grinding and/or ablation) to form a plurality of elementary emitters respectively originating from one and the same substrate. The result of such a design is a plurality of electroluminescent blocks all originating from one and the same substrate and electrically connected so as to be able to be activated selectively from one another.

In one exemplary embodiment according to this other embodiment, the substrate of the monolithic matrix array may have a thickness of between 10 μm and 800 μm, in particular equal to 200 μm; each block may have a length and a width, each being between 50 μm and 500 μm, preferably between 100 μm and 200 μm. In one variant, the length and the width are equal. The height of each block is less than 500 μm, preferably less than 300 μm. Finally, the exit surface of each block may be formed via the substrate on the side opposite the epitaxy. The separating distance between two elementary emitters. The distance between each contiguous elementary emitter may be less than 1 mm, in particular less than 500 μm, and is preferably less than 200 μm.

As an alternative, both with electroluminescent rods extending respectively projecting from one and the same substrate, as described above, and with electroluminescent blocks obtained by slicing electroluminescent layers superimposed on one and the same substrate, the monolithic matrix array may furthermore comprise a layer of a polymer material in which the electroluminescent elements are at least partially embedded. The layer may thus extend over the entire extent of the substrate, or only around a given group of electroluminescent elements. The polymer material, which may in particular be silicone-based, creates a protective layer that makes it possible to protect the electroluminescent elements without impairing the diffusion of the light rays. Furthermore, it is possible to integrate, into this layer of polymer material, wavelength conversion means, for example luminophores, that are able to absorb at least some of the rays emitted by one of the elements and to convert at least some of said absorbed excitation light into an emission light having a wavelength that is different from that of the excitation light. Provision may be made without distinction for the luminophores to be embedded in the mass of the polymer material, or else to be arranged on the surface of the layer of this polymer material.

The pixelated light source may furthermore comprise a coating of reflective material to deflect the light rays to the exit surfaces of the light source.

The electroluminescent elements of submillimeter dimensions define a given exit surface in a plane substantially parallel to the substrate. It will be understood that the shape of this exit surface is defined as a function of the number and the arrangement of the electroluminescent elements that form it. It is thus possible to define a substantially rectangular shape of the emission surface, it being understood that the latter may vary and adopt any shape without departing from the context of the invention.

By using the measures proposed by the present invention, it becomes possible to propose a pixelated light source, or equivalently a matrix light source, intended to be voltage-driven, and capable of diagnosing an open-circuit fault with one of its constituent elementary sources or pixels. By using a load connected in parallel with the transistor that makes it possible to connect/disconnect an elementary light source of the matrix light source to/from its voltage source, a measurable leakage current is generated through the load, measuring the intensity of which makes it possible to diagnose an open-circuit fault with the elementary light source in question. When this load additionally comprises a controlled transistor, the leakage current flows only when diagnostics are in progress, thereby avoiding unnecessary current leakages that have a potential impact on the normal operation of the matrix light source. Since the diagnostic and feedback circuit is integrated into the matrix light source, it is able to be activated quickly.

Figure 2:
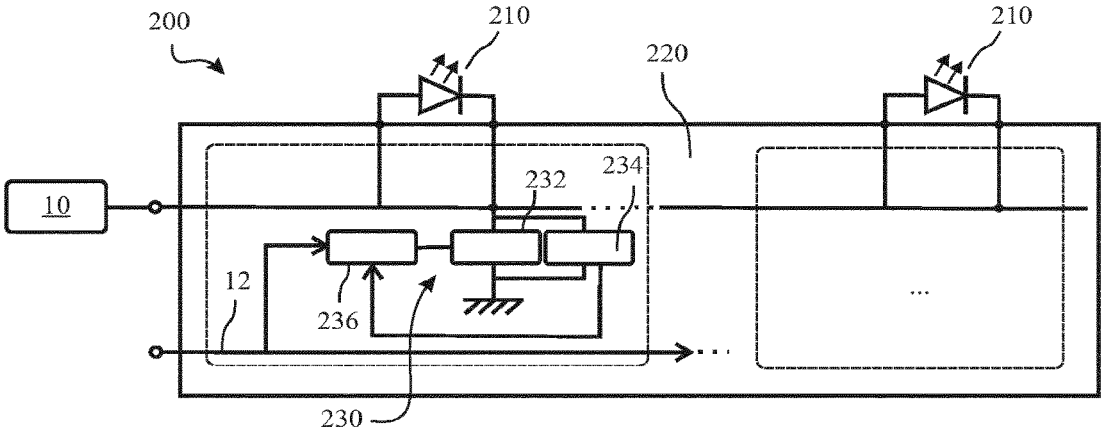
Figure 3:
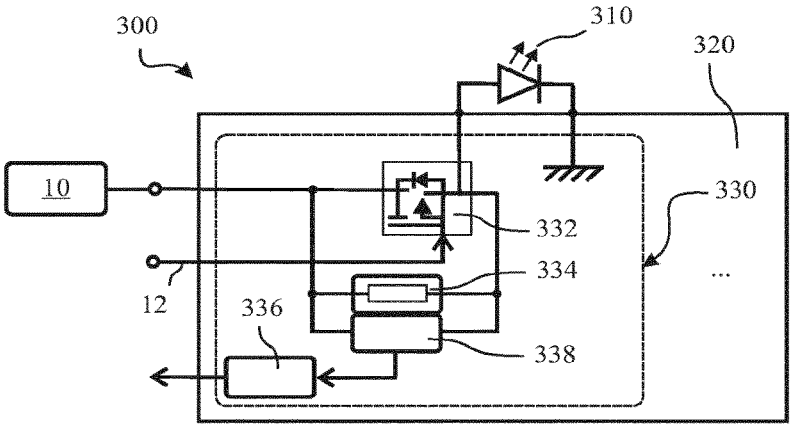
Figure 4:
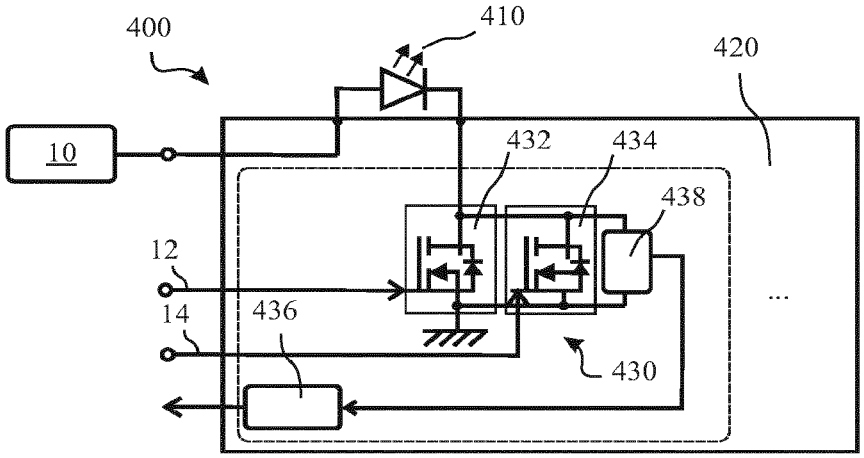
Figure 5:
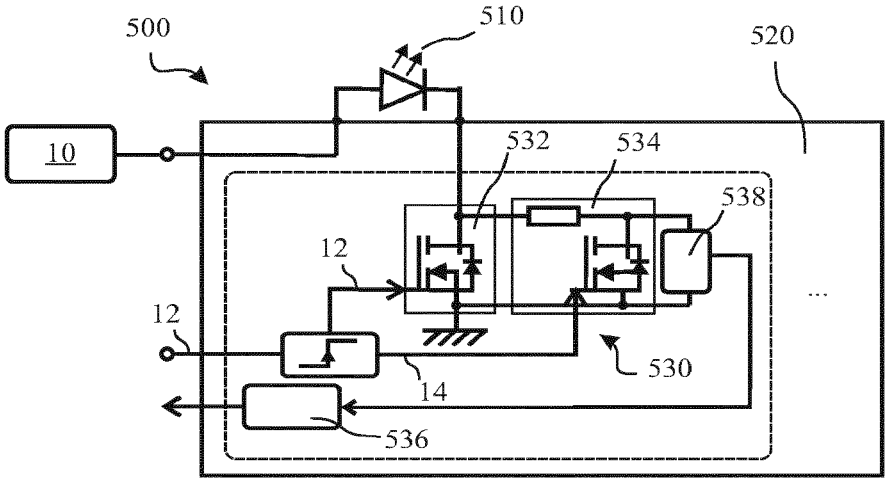

Other features and advantages of the present invention will be better understood with the aid of the description of the examples and of the drawings, in which:

FIG. 1 schematically shows a matrix light source according to one preferred embodiment of the invention;

FIG. 2 schematically shows a matrix light source according to one preferred embodiment of the invention;

FIG. 3 schematically shows a matrix light source according to one preferred embodiment of the invention;

FIG. 4 schematically shows a matrix light source according to one preferred embodiment of the invention;

FIG. 5 schematically shows a matrix light source according to one preferred embodiment of the invention.

Unless specified otherwise, technical features that are described in detail for one given embodiment may be combined with the technical features that are described in the context of other embodiments described by way of example and without limitation. Similar reference numerals will be used to describe similar concepts across various embodiments of the invention. For example, the references 100, 200, 300, 400 and 500 denote five embodiments of a matrix light source according to the invention.

The illustration in FIG. 1 shows a pixelated light source or matrix light source 100 according to one preferred embodiment of the invention. The matrix light source 100 is intended to be voltage-driven and comprises a plurality of electroluminescent semiconductor element-based elementary light sources 110 and a common substrate, not illustrated, in mechanical and electrical contact with and functionally connected to an integrated circuit 120. The elementary light sources are typically light-emitting diodes (LEDs).

The matrix light source 100 preferably comprises a monolithic matrix array component, in which the semiconductor layers of the elementary light sources 110 are for example arranged on the common substrate. The matrix array of elementary light sources 110 preferably comprises a parallel assembly of a plurality of branches, each branch comprising electroluminescent semiconductor light sources 110.

By way of example and without limitation, the matrix array of elementary light sources comprises, along the thickness of the substrate and starting at the end opposite the location of the elementary sources 110, a first electrically conductive layer deposited on an electrically insulating substrate. This is followed by an n-doped semiconductor layer whose thickness is between 0.1 and 2 μm. This thickness is much smaller than that of known light-emitting diodes, for which the corresponding layer has a thickness of the order of 1 to 2 μm. The following layer is the active quantum well layer having a thickness of around 30 nm, followed by an electron-blocking layer, and finally a p-doped semiconductor layer, the latter having a thickness of around 300 nm. Preferably, the first layer is an (Al)GaN:Si layer, the second layer is an n-GaN:Si layer, and the active layer comprises quantum wells made of InGaN alternating with barriers made of GaN. The blocking layer is preferably made of AlGaN:Mg and the p-doped layer is preferably made of p-GaN:Mg. n-doped gallium nitride has a resistivity of 0.0005 ohm/cm, whereas p-doped gallium nitride has a resistivity of 1 ohm/cm. The thicknesses of the proposed layers make it possible in particular to increase the internal series resistance of the elementary source, while at the same time significantly reducing its manufacturing time, as the n-doped layer is not as thick in comparison with known LEDs and requires a shorter deposition time. By way of example, a time of 5 hours is typically required for MOCVD depositions for a standard-configuration LED with 2μ of n layer, and this time may be reduced by 50% if the thickness of the n layer is reduced to 0.2μ.

In order to achieve elementary light sources 110 having semiconductor layers having homogeneous thicknesses, the monolithic component 100 is preferably manufactured by depositing the layers homogeneously and uniformly over at least part of the surface of the substrate so as to cover it. The layers are deposited for example using a metal oxide chemical vapor deposition (MOCVD) method. Such methods and reactors for implementing them are known for depositing semiconductor layers on a substrate, for example from patent documents WO 2010/072380 A1 or WO 01/46498 A1. Details on their implementation will therefore not be described in the context of the present invention. The layers thus formed are then pixelated. By way of example and without limitation, the layers are removed using known lithographic methods and by etching at the sites that subsequently correspond to the spaces separating the elementary light sources 110 from one another on the substrate. A plurality of several tens or hundreds or thousands of pixels 110 having a surface area smaller than one square millimeter for each individual pixel, and having a total surface area greater than 2 square millimeters, having semiconductor layers with homogeneous thicknesses, and therefore having homogeneous and high internal series resistances, are thus able to be produced on the substrate of a matrix light source 100. Generally speaking, the more the size of each LED pixel decreases, the more its series resistance increases, and the more this pixel is able to be driven by a voltage source. As an alternative, the substrate comprising the epitaxial layers covering at least part of the surface of the substrate is sawn or divided into elementary light sources, each of the elementary light sources having similar characteristics in terms of their internal series resistance.

The invention also relates to types of semiconductor element-based elementary light sources involving other configurations of semiconductor layers. In particular the substrates, the semiconductor materials of the layers, the layout of the layers, their thicknesses and any vias between the layers may be different from the example that has just been described, as long as the structure of the semiconductor layers is such that the internal series resistance of the elementary light source resulting therefrom is at least 1 ohm, and preferably at least 5 or 10 ohms, or else between 1 and 100 ohms.

The integrated circuit 120 is preferably soldered to the substrate of the monolithic source and furthermore comprises, for at least one but preferably for all of the elementary light sources 110, an open-circuit fault detection circuit 130. The matrix light source 100 is intended to be voltage-driven by an electric power supply drive circuit 10. Such circuits are known per se in the art, and their operation will not be described in detail in the context of the present invention. They involve at least one converter circuit capable of converting an input voltage, supplied for example by a voltage source internal to a motor vehicle, such as a battery, into an output voltage, having an intensity suitable for supplying power to the matrix light source. When the matrix light source is voltage-driven, the driving of each elementary source, or equivalently, of each pixel, merely entails controlling a switching device 132 as shown schematically in FIG. 1. By controlling the state of the device 132, the elementary light source 110 may be selectively connected to the voltage source 10. The switching device is for example formed by a MOSFET field-effect transistor, preferably characterized by a low voltage drop between its drain and source terminals, and controlled by a control signal from a control unit external to the matrix light source.

Preferably, not only the switch elements 132 but also a power supply circuit may be integrated into the substrate 120 when the monolithic component 100 is manufactured.

The illustration in FIG. 2 shows a pixelated light source or matrix light source 200 according to another preferred embodiment of the invention. The matrix light source 200 is intended to be voltage-driven and comprises a plurality of electroluminescent semiconductor element-based elementary light sources 210 and a common substrate, not illustrated, in contact with an integrated circuit 220 to which the substrate is functionally connected. The elementary light sources are typically light-emitting diodes (LEDs).

The integrated circuit 220 furthermore comprises, for at least one elementary light source 210, an open-circuit fault detection circuit 230. When the matrix light source is voltage-driven, the driving of each elementary source, or equivalently, of each pixel, merely entails controlling a switching device 232. By controlling the state of the device 232, the elementary light source 210 may be selectively connected to the voltage source 10. The switching device 232 is for example formed by a MOSFET field-effect transistor, preferably characterized by a low voltage drop between its drain and source terminals, and controlled by a control signal 12 from a control unit external to the matrix light source. FIG. 2 shows a control signal 12 intended for a plurality of elementary light sources 210. However, it goes without saying that the invention extends to the case where each elementary light source 210 is controlled by a control signal 12 that is specific thereto.

The open-circuit fault detection circuit 230 furthermore comprises a load 234, connected in parallel with the switching device 232. When the matrix light source is powered and the elementary light source 210 is not connected to the voltage source (switch 232 open) and an electric leakage current is flowing through the load, it may be concluded that the light source 210 does not have an open-circuit fault. If on the other hand the electric current flowing through the load 234 is of zero or negligible intensity, it should be concluded that the light source 210 has an open-circuit fault. In the latter case, a fault detection indication is recorded in a memory element 236 provided for this purpose. This makes the information, which is preferably binary information, accessible to an external entity that is designed to read the contents of the memory element 236.

The illustration in FIG. 3 shows a pixelated light source or matrix light source 300 according to another preferred embodiment of the invention. The matrix light source 300 is intended to be voltage-driven and comprises a plurality of electroluminescent semiconductor element-based elementary light sources 310 and a common substrate, not illustrated, in contact with an integrated circuit 320.

The integrated circuit 320 furthermore comprises, for at least one elementary light source 310, an open-circuit fault detection circuit 330. When the matrix light source is voltage-driven, the driving of each elementary source, or equivalently, of each pixel, merely entails controlling a MOSFET field-effect transistor device 332. By controlling the state of the transistor 332, the elementary light source 310 may be selectively connected to the voltage source 10. The transistor is preferably characterized by a low voltage drop between its drain and source terminals. It is and controlled by a control signal 12 from a control unit external to the matrix light source. If the transistor 232 is in the on state, the elementary light source 310 is powered and it lights up if it is not defective. If on the other hand the transistor is in its off state, the elementary light source 310 is not connected to the voltage source.

The open-circuit fault detection circuit 330 furthermore comprises a load 334 comprising a resistor, for example of 700 ohms, connected in parallel with the switching device 332. When the matrix light source is powered and the elementary light source 310 is not connected to the voltage source (transistor 332 in the off state) and an electric leakage current of non-negligible intensity is flowing through the load, it may be concluded that the light source 310 does not have an open-circuit fault. If on the other hand the electric current flowing through the load 334 is of zero or negligible intensity, it should be concluded that the light source 310 has an open-circuit fault. A comparison circuit 338 compares the voltage drop across the terminals of the resistor 334 to a predetermined threshold value. The threshold value may for example be 0.7 V. If the voltage drop across the terminals of the resistor 334 is less than 0.7 V, a fault detection indication is recorded in a memory element 336 provided for this purpose. This makes the detection information, which is preferably binary information, accessible to an external entity that is designed to read the contents of the memory element 336. This embodiment solves the problem of diagnosing an open-circuit fault. However, it generates a constant current leakage.

The illustration in FIG. 4 shows a pixelated light source or matrix light source 400 according to another preferred embodiment of the invention. The matrix light source 400 is intended to be voltage-driven and comprises a plurality of electroluminescent semiconductor element-based elementary light sources 410 and a common substrate 420.

The substrate 420 furthermore comprises, for at least one elementary light source 410, an open-circuit fault detection circuit 430. When the matrix light source is voltage-driven, the driving of each elementary source, or equivalently, of each pixel, merely entails controlling a MOSFET field-effect transistor device 432. By controlling the state of the transistor 432, the elementary light source 410 may be selectively connected to the voltage source 10. The transistor 432 is preferably characterized by a low voltage drop between its drain and source terminals. It is controlled by a control signal 12 from a control unit external to the matrix light source.

The open-circuit fault detection circuit 440 furthermore comprises a load 434 comprising a second transistor preferably characterized by a large voltage drop between its drain and source terminals, for example of the order of 0.7 V, connected in parallel with the first transistor 432. The state of the transistor 434 is controlled by a control signal 14 from, in the case illustrated by FIG. 4, a control unit external to the matrix light source. This arrangement makes it possible to put the transistor 434 only into the on state when an open-circuit fault diagnosis takes place.

An open-circuit fault with the elementary light source 410 is able to be detected when the first transistor (switch) 432 is in the off state, while the second transistor (load) 434 is in the on state. In fact, the second transistor 434 may for example be put into the on state briefly before the first transistor changes to the on state. As an alternative, the second transistor 434 may be put into the on state briefly before the first transistor 432 is switched from its on state to the off state, the second transistor 434 thereafter remaining in the on state for a predetermined period of time. Other combinations may be contemplated without otherwise departing from the scope of the present invention and without creating optically perceptible effects in the luminous flux emitted by the matrix light source.

When diagnosing an open-circuit fault, the comparison circuit 438 compares the voltage drop across the terminals of the load 434 to a predetermined threshold value. The threshold value may for example be 0.7 V. If the voltage drop across the terminals of the resistor 434 is less than 0.7 V, a fault detection indication is recorded in a memory element 436 provided for this purpose. This makes the detection information, which is preferably binary information, accessible to an external entity that is designed to read the contents of the memory element 436. This embodiment solves the problem of diagnosing an open-circuit fault. However, it generates a constant current leakage.

FIG. 5 schematically shows another preferred embodiment of the invention, which is a variant of the embodiment that has just been described with reference to the illustration of FIG. 4.

The matrix light source 500 is intended to be voltage-driven and comprises a plurality of electroluminescent semiconductor element-based elementary light sources 510 and a common substrate, not illustrated, functionally connected to an integrated circuit 520.

The integrated circuit 520 furthermore comprises, for at least one elementary light source 510, an open-circuit fault detection circuit 530. When the matrix light source is voltage-driven, the driving of each elementary source, or equivalently, of each pixel, merely entails controlling a MOSFET field-effect transistor device 532. By controlling the state of the transistor 532, the elementary light source 510 may be selectively connected to the voltage source 10. The transistor 532 is preferably characterized by a low voltage drop between its drain and source terminals. It is controlled by a control signal 12 from a control unit external to the matrix light source.

The open-circuit fault detection circuit 540 furthermore comprises a load 534 connected in parallel with the switching transistor 532. The load 534 comprises a second transistor and a resistor connected in series with the second transistor. The intensity of the leakage current that is able to flow in this branch is defined primarily by the value of the resistor. In fact, the second transistor, forming part of the load branch 534, may have a low voltage drop between its drain and source terminals. The state of the transistor 534 is controlled by a control signal 14 from, in the case illustrated by FIG. 5, a control unit that generates it from the control signal 12 that is intended to control the state of the switching transistor 532. The control signal 12 is generated in this example by a control unit external to the matrix light source. This arrangement makes it possible to put the second, and therefore to connect the entire load 534, only into the on state when an open-circuit fault diagnosis takes place.

An open-circuit fault with the elementary light source 510 is able to be detected when the first transistor (switch) 532 is in the off state, while the second transistor (load) 534 is in the on state. In fact, the control unit having, as input, the control signal 12 that is relayed to the first switching transistor 532, and generating the control signal 14 for the second transistor of the load 534, is preferably configured so as to generate the control signal 14 such that the second transistor changes to the on state when the first transistor 532 switches to its off state. The falling edge of the binary signal 12 thus coincides with the rising edge of the binary signal 14. Electronic circuits for implementing the functionality described for the control unit are within the ability of those skilled in the art, without otherwise departing from the scope of the present invention. This control circuit is preferably integrated into the integrated circuit 520 of the matrix light source.

When diagnosing an open-circuit fault, the comparison circuit 538 compares the voltage drop across the terminals of the load 534 to a predetermined threshold value. The threshold value may for example be 0.7 V. If the voltage drop across the terminals of the load 534 is less than 0.7 V, a fault detection indication is recorded in a memory element 536 provided for this purpose. This makes the detection information, which is preferably binary information, accessible to an external entity that is designed to read the contents of the memory element 536. This embodiment generates a leakage current through the load 532 only when an open-circuit fault diagnosis takes place. If this is not the case, no electrical energy is dissipated by the load.

It goes without saying that the integrated circuit may comprise other electronic circuits and/or memory elements used for other functions in connection with the matrix light source and/or with the elementary light sources.

The scope of protection is defined by the claims.

The invention claimed is:

1. A matrix light source intended to be supplied with a voltage and comprising an integrated circuit and a matrix array of electroluminescent semiconductor element-based elementary light sources, wherein the integrated circuit is in contact with the matrix array and comprises, for each elementary light source, a switching device for selectively connecting a respective elementary light source to a voltage source on the basis of a first control signal, wherein the integrated circuit comprises, for at least one of the elementary light sources, an open-circuit fault detection circuit for detecting an open-circuit fault with the elementary light source, wherein said open-circuit fault detection circuit comprises a load connected in parallel with the switching device, such that an electric current of non-negligible intensity flows through the load if the matrix source is supplied with electricity, unless the elementary light source has an open-circuit fault.

2. The matrix light source as claimed in claim 1, wherein the open-circuit fault detection circuit is configured so as to generate binary information on the detection of an open-circuit fault with said elementary light source.

3. The matrix light source as claimed in claim 2, wherein the open-circuit fault detection circuit comprises a memory element, the open-circuit fault detection circuit being configured so as to store the detection information in said memory element.

4. The matrix light source as claimed in claim 1, wherein said open-circuit fault detection circuit comprises a comparison unit, configured so as to compare the voltage drop across the terminals of said load to a predetermined threshold value.

5. The matrix light source as claimed in claim 1, wherein said load comprises a resistor connected in parallel with the switching device.

6. The matrix light source as claimed in claim 1, wherein said load comprises a transistor controlled by a second control signal, the transistor representing a non-negligible resistance when it is in the closed state, and wherein the open-circuit fault detection circuit comprises a control unit for generating said second control signal.

7. The matrix light source as claimed in claim 6, wherein the second control signal depends on the first control signal.

8. The matrix light source as claimed in claim 1, wherein the integrated circuit comprises a respective open-circuit fault detection circuit for each of the elementary light sources.

9. The matrix light source as claimed in claim 1, wherein the elementary light sources are arranged in at least two branches of parallel sources.

10. A lighting module for a motor vehicle, comprising a matrix light source and a circuit for driving the supply of electric power to said matrix light source, wherein the matrix light source is as claimed in claim 1.

11. A method for detecting an open-circuit fault with a matrix light source, wherein the method comprises the following steps:

supplying a voltage to the matrix light source, the matrix light source comprising an integrated circuit and a matrix array of electroluminescent semiconductor element-based elementary light sources, wherein the integrated circuit is in contact with the matrix array and comprises, for each elementary light source, a switching device for selectively connecting a respective elementary light source to a voltage source on the basis of a first control signal;

by way of a control device for the matrix light source, generating at least a first signal for controlling the state of the switching device so as to selectively connect at least one elementary light source of the matrix light source to the voltage source;

when said elementary light source is not connected to the voltage source by way of its switching device, comparing the voltage drop across the terminals of a load connected in parallel with the switching device to a predetermined threshold voltage; and detecting the presence of an open-circuit fault with said elementary light source on the basis of the result of this comparison, wherein an electric current of non-negligible intensity flows through the load if the matrix source is supplied with electricity, unless the elementary light source has an open-circuit fault.

12. The matrix light source as claimed in claim 2, wherein said open-circuit fault detection circuit comprises a comparison unit, configured so as to compare the voltage drop across the terminals of said load to a predetermined threshold value.

13. The matrix light source as claimed in claim 12, wherein said load comprises a resistor connected in parallel with the switching device.

14. The matrix light source as claimed in claim 13, wherein said load comprises a transistor controlled by a second control signal, the transistor representing a non-negligible resistance when it is in the closed state, and wherein the open-circuit fault detection circuit comprises a control unit for generating said second control signal.

15. The matrix light source as claimed in claim 14, wherein the second control signal depends on the first control signal.

16. The matrix light source as claimed in claim 2, wherein the integrated circuit comprises a respective open-circuit fault detection circuit for each of the elementary light sources.

17. The matrix light source as claimed in claim 2, wherein the elementary light sources are arranged in at least two branches of parallel sources.

18. A matrix lighting module for a motor vehicle, comprising a matrix light source and a circuit for driving the supply of electric power to said matrix light source, wherein the matrix light source is as claimed in claim 2.

* * * * *